United States Patent [19]

Funk et al.

[11] 4,027,509

[45] June 7, 1977

[54] CYLINDER LOCK FOR ROTARY SWITCHES

[75] Inventors: Adolf Funk; Heinz Kuster, both of Wetzikon, Switzerland

[73] Assignee: Bauer Kaba AG. Sicherheits-Schliessysteme, Switzerland

[22] Filed: June 23, 1976

[21] Appl. No.: 698,918

[30] Foreign Application Priority Data

July 2, 1975 Switzerland ..... 8606/75

[52] U.S. Cl. ..... 70/379 R; 70/362

[51] Int. Cl.² ..... E05B 17/04

[58] Field of Search ..... 70/357, 362, 372, 379 R, 70/379 A, 380, 419, 421

[56] References Cited

UNITED STATES PATENTS

| | | | |
|---|---|---|---|
| 1,010,727 | 12/1911 | Corbin | 70/379 R |
| 1,361,756 | 12/1920 | Egbert | 70/379 R |
| 2,049,742 | 8/1936 | Lowe | 70/379 R |
| 2,431,894 | 12/1947 | Spain | 70/362 |

*Primary Examiner*—Robert L. Wolfe

*Attorney, Agent, or Firm*—Roylance, Abrams, Berdo & Kaul

[57] ABSTRACT

A cylinder lock for a rotary switch having a rotor, a stator surrounding the rotor and an engagement sleeve surrounding the stator. The engagement sleeve is attached to the fixed portion of the rotary switch and the stator is coupled to the movable portion thereof. Separate latching devices are provided between the stator and engagement sleeve and between the rotor, stator and engagement sleeve. Sets of tumblers are also provided between the rotor and stator and the rotor has a key slot, the position of which indicates the switch position. Insertion and rotation of the key rotates the rotor, disengaging the tumblers and the latching device between the rotor, stator and sleeve, permitting the rotor to rotate alone through a predetermined angle. Further, torque applied to the key causes the latching device between the stator and sleeve to disengage, rotating the stator and the rotary switch to the new switch position at which the stator-sleeve latching device re-engages in that new position. The rotor then is returned through the same small angle and the key can be removed. The number of switch positions is independent of the number of tumblers. The key is removable in any switch position.

13 Claims, 14 Drawing Figures

CYLINDER LOCK FOR ROTARY SWITCHES

This invention relates to a cylinder lock for rotary switches, the lock having a plurality of key removal positions and an indication of the switch positions by the rotational position of the key slot.

BACKGROUND OF THE INVENTION

Cylinder locks are known in which a rotary switch is built directly onto a cylinder lock and is used for various purposes, for example, for on-off switching of electrical circuits, step switching, activating operating controls for machines or equipment or groups thereof, for operating shut-off valves, multiway valves, etc., and can only be operated by the insertion of a key which fits the lock and wherein the key can only be removed when the switch has been moved to an engaged position.

However, such cylinder locks can only have a limited number, usually three but generally a maximum of eight, tumblers, whereby, based on the complete rotation of the key or rotor, it is only possible to economically obtain with such switches a maximum of four switch positions angularly separated by 90° because the hole pattern of the tumblers in the stator is multiplied corresponding to the number of key removal positions. In other words, the number of rows of stator bores must be multiplied by this quantity. Thus, these prior art cylinder locks with a plurality of removal positions which, being coaxially assembled with the actual rotary switch as a switch unit (also called "switch cylinders") are often inadequate to provide the flexibility in switching programs which is needed, are not very reliable due to the small number of tumblers which can be used, and, due to the limited number of possible variations, limiting the permutations available, these cannot be used for locking systems. In general, cylinder locks with shims cannot be provided with a plurality of removal positions for the keys because the shims can become displaced, thereby accentuating the disadvantages of the prior structures.

An object of the present invention is to provide a cylinder lock which overcomes the aforementioned disadvantages and which includes a lock having a plurality of removal positions in which the number of locking openings is selected independently of the arrangement and number of tumblers in the cylinder lock.

Briefly described, the invention includes a cylinder lock for a rotary switch of the type having a stationary part and a movable part rotatable to any one of a predetermined number of positions, the lock comprising a stationary housing coupled to the stationary part of the switch, a stator mounted for rotary motion in the housing and coupled to the movable part of the switch, means for restraining the stator against axial motion relative to the housing, a rotor mounted in the stator for rotary motion relative thereto, the rotor having an operating link attached thereto and rotatable therewith and a key slot to permit insertion and removal of a key in any one of a plurality of rotational positions of the rotor, the positions of said key slot providing a visible indication of switch position, tumbler means in the rotor and stator for preventing relative motion therebetween in the absence of a key in the slot, a locking bolt coupled to the link, the stationary housing having means defining a plurality of locking openings corresponding to the number of switch positions for receiving an end of the locking bolt, the locking bolt being transversely movable between a first position in which the bolt engages one of the locking openings in the housing and a second position in which the bolt is disengaged from the openings, said bolt being movable toward the second position by the link upon rotation of the rotor, spring means for urging the bolt toward the first position, the stator being locked against rotation by said bolt when the bolt is in the first position, the stator, rotor and bolt being rotatable relative to the housing when the bolt is in the second position to move the switch to a new position, the number of the locking openings being selectable independently of the number and arrangement of tumbler means in the cylinder lock.

In order that the manner in which the foregoing and other objects are attained in accordance with the invention can be understood in detail, particularly advantageous embodiments thereof will be described with reference to the accompanying drawings, which form a part of this specification, and wherein.

DETAILED DESCRIPTION OF THE PREFERRED EMBODIMENTS

Figure 1:
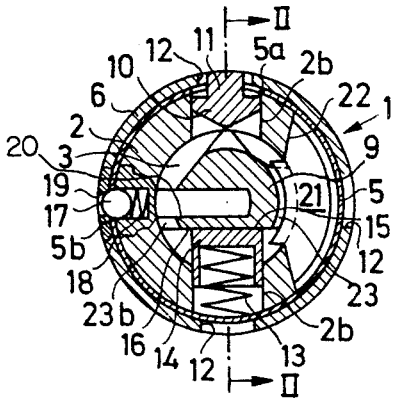
FIG. 1 is a front elevation, in partial section, of a cylinder lock in an engaged switching or operating position with the key removed.
Figure 2:
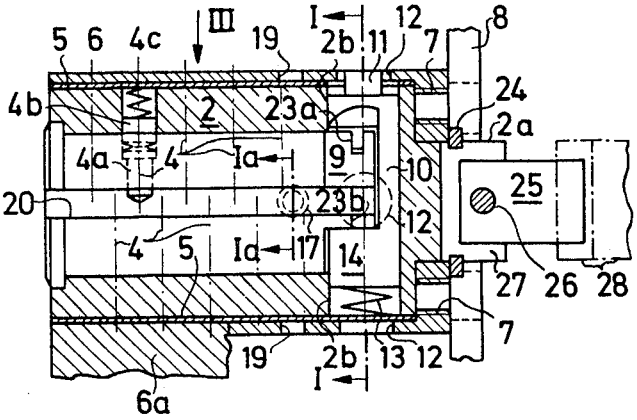
FIG. 2 is a side elevation, in section, along lines II—II of FIG. 1.

As shown in FIGS. 1 and 2, a cylinder lock 1, also called a lock cylinder, contains some components which are conventional. The lock includes a stator 2, a rotor 3 rotatably mounted in the stator, and groups of tumblers 4 which are arranged in rows in the axial or longitudinal direction of lock cylinder 1 as well as in a lock cylinder sleeve 5. Lock cylinder 1 is mounted to be rotatable but axially non-displaceable in a fixed part 6 of the actual switch, which, in the embodiment illustrated, is constructed as an engagement sleeve which surrounds the lock cylinder sleeve 5. In the specific embodiment shown, the engagement sleeve 6 is provided with an inwardly extending back sleeve base portion having two threaded bores 7. Two screws, as indicated in FIG. 2, pass through bores 7 and through similar openings in a stationary switch plate 8 by which engagement sleeve 6 is fixedly attached to switch plate 8. Rotor 3 has at its rear end an operating link 9, also seen in FIG. 13, by which the rotor is in continuous coupling relationship with a locking bolt 10, also seen in FIG. 14. Locking bolt 10 is mounted so as to be diametrically movable in radial bores 2*b* in the stator 2. In the rotational position of rotor 3 shown in FIG. 1, a planar surface 15 of locking bolt 10 engages a planar surface 16 of operating link 9. In that position, a conical lug 11 formed on bolt 10 passes through and engages a radial opening 5*a* of the lock cylinder sleeve 5 in a radial locking opening 12 on the periphery of the engagement sleeve 6. When the rotor is rotated, locking bolt 10 is moved radially by operating link 9 from the locked position shown in FIG. 1, moving lug 11 radially inwardly and unlocking lock cylinder 1 from the engagement sleeve 6, so that the lock cylinder 1 is released and permitted to commence its rotary movement for operation of the switch, as will be explained in greater detail hereinafter. A locking bolt compression spring 13 is received within a sleeve-like base portion 14 of locking bolt 10, the other end of compression spring 13 being supported on the inner wall of lock cylinder sleeve 5. In the inoperative position of the lock cylinder 1 shown in FIG. 1, spring 13 urges locking bolt 10 upwardly with its surface 15 against surface 16 of operating link 9. Thus, the locking bolt is held in its locked position.

In the specific embodiment shown, lock cylinder 1 is equipped to have four operating positions, i.e., engagement sleeve 6 is provided with four locking openings 12 for rotational operation to any one of four positions angularly separated by 90° as viewed in a plane perpendicular to the lock cylinder axis.

In addition to locking bolt 10, a second spring-urged engagement member is provided in lock cylinder 1 which, in this embodiment, is constructed as a spherical spring bolt or detent member and is identified by reference numeral 17. Spherical spring bolt 17 is urged radially outwardly by a bolt spring 18, the other end of spring 18 is received in a recess in stator 2. Spring bolt 17 is urged outwardly against the edge of a passage opening 5b provided on the periphery of lock cylinder sleeve 5, the coaction of bolt 17 with the opening determining the locking or unlocking of lock cylinder 1 in or relative to engagement sleeve 6 and therefore with respect to the actual switch. In FIG. 1, which shows the inoperative position of lock cylinder 1, the spherical spring bolt 17, like locking bolt 10, is in its engaged position wherein the spherical spring bolt engages in a radial engagement opening 19 of engagement sleeve 6.

Corresponding to the four operating positions of lock cylinder 1 and the actual switch, the engagement sleeve 6, in addition to the four locking openings 12 for locking bolt 10, is provided with four engagement openings 19, each of these corresponding to an operating rotational angle of 90°, these also being arranged in a common plane perpendicular to the lock cylinder axis and located in front of, i.e., axially separated from, the plane of the four locking openings 12 as shown in FIG. 2. In this embodiment, the four engagement openings 19 and the four locking openings 12 are arranged in pairs in two perpendicular longitudinal median planes of lock cylinder 1. In each of the four operating positions of lock cylinder 1, or the switch itself, the operating bolt 10 and the spherical spring bolt 17 are in their locked or engaged positions and, at the same time, rotor 3 is in its locked rotation position in which a fitting key can be inserted into or removed from the key slot 20 of rotor 3. It will be observed that, whereas locking bolt 10 serves only to lock or unlock cylinder 1 for rotary motion with respect to stator 2 in engagement sleeve 6, the operating engagement member 17, constructed as a spherical spring bolt, effects the actual switching on-and-off process.

A plate-like rotor holder 21 is inserted from the outside through a narrow recess 22 milled in stator 2 at right angles to the lock cylinder axis and enters into a corresponding slot 23 in operating link 9 and secures the rotor 3 against axial displacement with respect to stator 2, this also being seen in FIGS. 3, 5, 7, 9 and 13. For the sake of completeness, it will also be noted that, in addition to slot 23, the operating link 9 has two further recesses 23*a* and 23*b* which are located in a common plane with slot 23 perpendicular to the rotor axis. However, recesses 23*a* and 23*b* have no function and are formed simply because the rotor is rotated during insertion of the milling blade during the process of forming slot 23.

FIG. 2 illustrates two banks of tumblers 4, these tumbler banks being located in a common plane passing through the central axis of lock cylinder 1, the tumblers in the two banks being axially offset relative to one another in the longitudinal direction. For simplicity, FIG. 2 shows only one of the tumblers 4 with its tumbler pin 4*a*, its counter-tumbler 4*b* and its spring 4*c*, but it will be recognized that the centerlines shown in FIG. 2 indicate the existence of similar tumblers at those positions. While the rotor 3 is in an operational position of the switch, i.e., in a rotational position appropriate for key removal or key insertion in slot 20, the counter-tumblers 4*b* engage the rotor from the outside in the appropriate radially inwardly extending rotor bores, thereby securing rotor 3 against rotation relative to stator 2 and simultaneously preventing unauthorized operation of the switch. The arrangement of the tumbler banks and the number of tumblers 4 can be selected independently of the number of switch positions. By means of a guard ring 24, in this case a so-called Seeger ring, the stator 2, and, therefore, the complete lock cylinder 1, is secured against forward axial displacement with respect to engagement sleeve 6.

A drive arm 25 is connected in an articulated manner in a radial slot 27 of a cylindrical extension 2*a* by a pin 26 which extends through extension 2*a* and arm 25. Arm 25 transmits the rotary movement of the stator and its extension 2*a* to a rotational part 28 of the switch itself, preferably a switch shaft located coaxially with the lock cylinder axis. FIG. 2 also shows the substantially U-shaped configuration of the locking bolt 10 and its relationship with operating link 9 of rotor 3, whereby the operating link projects into the recess of the locking bolt, resulting in the continuous coupling of rotor 3 to the locking bolt, insuring the constant operative connection of these two parts during the rotation of rotor 3 in stator 2.

As schematically indicated at 6*a* in FIG. 2, the stationary switch part provided with locking and engagement openings 12 and 19, respectively, instead of being constructed as an engagement sleeve 6 which is fixed at its back by means of screws to a fixed front switch plate 8, can alternatively be constructed as the actual switch casing, in which case the locking and engagement openings can be formed as blind bores.

Figure 3:
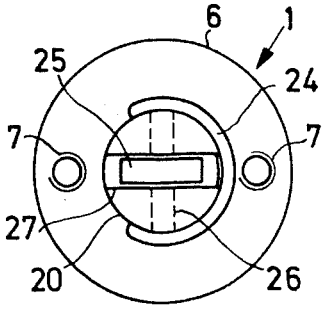
FIG. 3 is a rear elevation of the lock of FIG. 2, rotated 90°.
Figure 4:
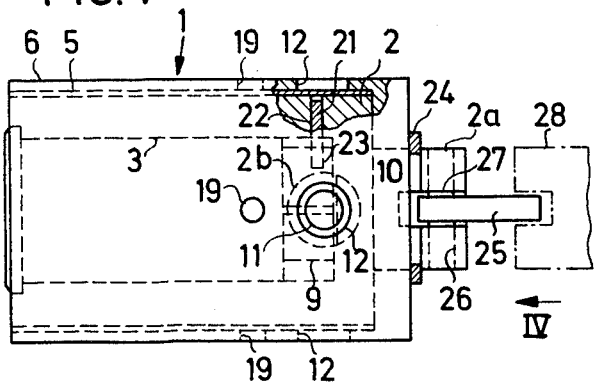
FIG. 4 is a plan view of the lock of FIG. 2 in the direction of the arrow III.

FIGS. 3 and 4 show front elevation and plan views, respectively, of the lock cylinder 1 in the initial angular positions of FIGS. 1 and 2 with the key removed and with the mechanism secured against rotation with respect to engagement sleeve 6 by locking bolt 10 and wherein rotor 3 is simultaneously locked by tumblers 4 against rotation with respect to stator 2.

Figure 5:
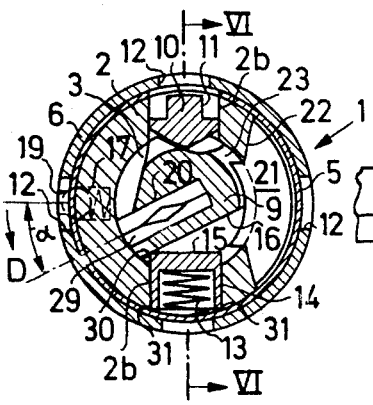
FIGS. 5, 7, 9 and 11 are front elevations, in section, of the lock of FIGS. 1–4 in various rotational positions used for explanatory purposes.

FIG. 5 shows the locked cylinder 1 with a key 29 inserted in key slot 20 after rotating the unlocked rotor 3 from its insertion position of FIGS. 1–4 through a rotation angle $\alpha$ in the direction of arrow D. When key 29 is inserted into key slot 20, tumblers 4 are arranged along the cylindrical line of separation between rotor 3 and stator 2 so that the rotor is released and can rotationally move. Rotor 3 is rotated through the agle $\alpha$ until the locking bolt 10 radially displaceably mounted in radial stator bores 2*b* strikes against strike points 31 of lock cylinder sleeve 5 with the edge of its sleeve-like base portion 14, which striking is detectable on rotating key 29. During rotor rotation, locking bolt 10 is also extracted from locking opening 12 engagement sleeve 6 counter to the pressure of locking bolt spring 13 by operating link 9 through the action of pressure transfer point 30 on its surface 16. It will be observed that stator 2, in the position shown in FIG. 5, has not yet undergone any rotation and is still as shown in FIG. 1, resting in engagement with sleeve 6, being coupled thereto by spherical slide bolts 17 in engagement openings 19 and the switch, therefore, has also not undergone any rotational movement. FIG. 5 also shows that the rotor itself cannot be rotated any farther relative to stator 2 in the direction of the arrow D beyond the angular movement depicted by angle $\alpha$.

Figure 6:
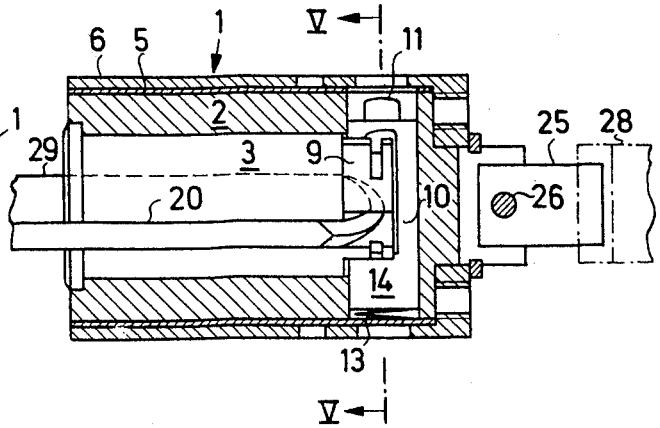
FIGS. 6, 8, 10 and 12 are side elevations, in partial section, of the locks in the positions shown in FIGS. 5, 7, 9 and 11, respectively.

FIG. 6 shows the lock cylinder 1 in a longitudinal section but in the same phase of rotation depicted in FIG. 5. Due to the rotation of rotor 3, locking bolt spring 13 is compressed by locking bolt 10 when the locking bolt is withdrawn from its locked position. Stator 2, together with lock cylinder sleeve 5, drive arm 25 and its hinge pins 26, as well as the switch shaft 28, are still in the same positions which will be seen by comparing FIGS. 6 and 2. Only the rotational position of rotor 3 and operating link 9 has changed, thereby retracting locking bolt 10 into its unlocking position.

Figure 7:
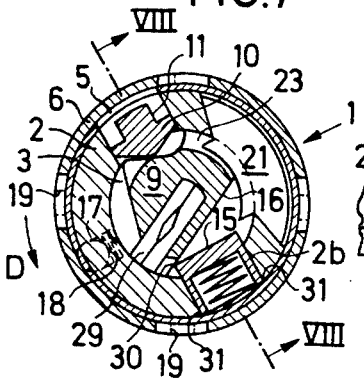

FIG. 7 illustrates the position of rotor 3 when that rotor has been rotated in the direction of arrow D beyond the angular movement represented by angle $\alpha$, at which time stator 2 has also been rotated relative to he positions shown in FIGS. 1–6. The joint rotation of stator 2, together with lock cylinder sleeve 5, occurs because surface 16, in engagement with pressure transfer point 30 of locking bolt 10, cannot cause any further transverse radial displacement of the bolt, the stop points 31 of which are in contact with the inner surface of sleeve 5. Bolt 10 is therefore forced to move angularly, pressing against the inner surface of bore 2*b* in stator 2 and causing rotational movement of the stator. During and as a result of the rotation of stator 2, the spherical spring bolt 17 disengages from the engagement opening 19 of engagement sleeve 6, counter to the outward urging of compression spring 18, and the stator then moves in rotation direction D and spring bolt 17 is caused to move toward the next engagement opening 19, locking bolt 10 still being retracted in its unlocked position.

Figure 8:
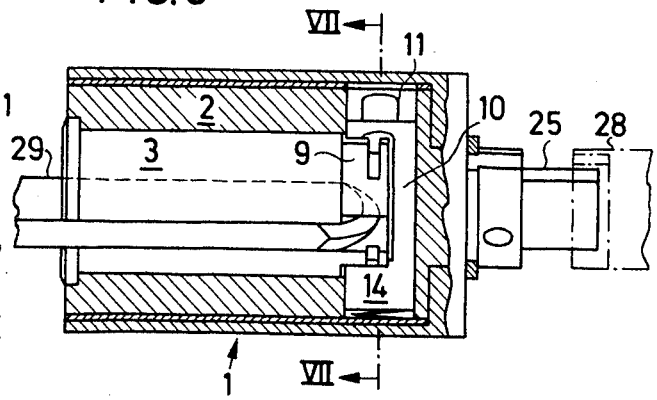

FIG. 8 depicts a longitudinal section through the lock cylinder in the rotational position of the rotor and stator described in FIG. 7. During the rotation of stator 2, drive arm 25 and therefore also switch shaft 28 are rotated, but it will be noted that the switch is still not in its new switch position.

Figure 9:
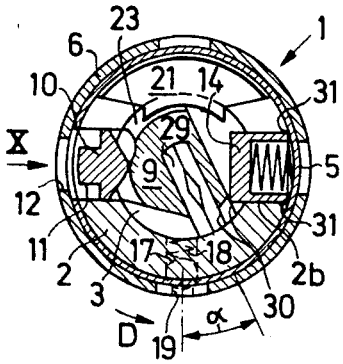

As shown in the FIG. 9, rotor 3, together with stator 2, i.e., the complete lock cylinder 1, has been rotated through a further angle in the direction of arrow D from the position shown in FIG. 7, the position shown in FIG. 9 being that in which the shperical spring bolt 17 is urged outwardly by compression spring 18 to engage in the next engagement opening 19 of sleeve 6, the position thus illustrated being that in which the switch has been moved into its next operating position, 90° displaced from that shown in FIGS. 1 and 2. However, during the further rotation of lock cylinder 1 into the position shown in FIG. 9, the locking bolt 10, which, together with its locking lug 11, is located adjacent the next locking opening 12 of engagement sleeve 6, is still retracted in its unlocked position and, additionally, the stop and transfer relationship between operating link 9, locking bolt base 14, lock cylinder sleeve 5 and the wall of the radial stator bore 2 with pressure transfer points 30 and stop points 31 remain unchanged. To this extent, FIG. 9 coincides with FIGS. 7 and 5. As will be seen from a comparison between FIGS. 9 and 7, rotor 3 has been rotated beyond the new locked position of circle spring bolt 17 by rotation angle $\alpha$ during this further rotation, in which the locking bolt 10 has been brought in front of the next locking opening 12.

Figure 10:
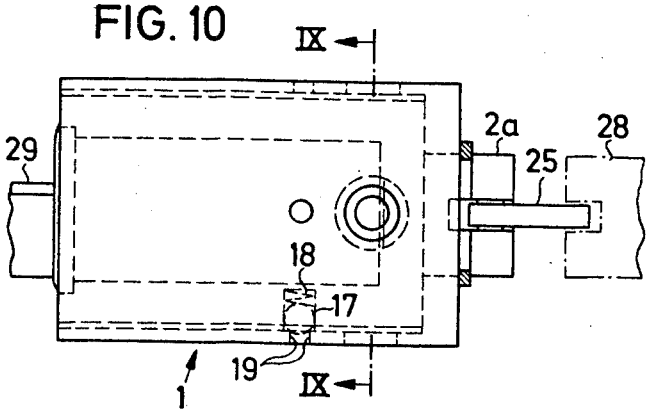

FIG. 10 is a side view of lock cylinder 1 with the key 29 stll inserted, the lock being in the rotated position shown in FIG. 9. During this further rotation in which stator 2 has also rotated and the spherical spring bolt 17 has gone through the smallest possible rotational path of 90° between two successive engagement openings 19 (in the embodiment wherein four operating positions are provided), drive arm 25 has simultaneously been rotated with the rear stator shoulder extension 2*a* and arm 25 has rotated switch shaft 28 and 90° up to the next switch position, as will be seen by comparing FIGS. 10 and 2.

Figure 11:
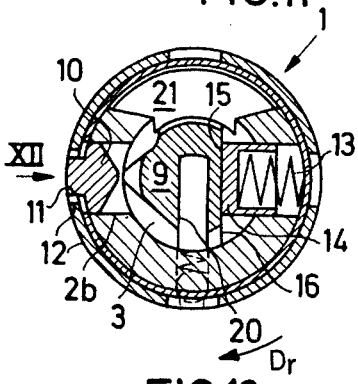

FIG. 11 shows a section of lock cylinder 1 wherein rotor 3 alone has been rotated in the reverse direction through an angle $\alpha$ with respect to FIG. 9 in the direction of the arrow $D_r$, into its new insertion or removal position for the key and after the removal thereof. In that figures, the locking bolt spring 13 has rotated rotor 3 back to a position 90° displaced from that shown in FIG. 1 wherein surfaces 15 and 16 are again in engagement, this having been accomplished by the inward urging of spring 13 against locking bolt 10 and the action of pressure point 30 against operating link 9, and has simultaneously displaced locking bolt 10 in the opposite direction from its original movement and into its new locking position wherein locking lug 11 has engaged the next locking opening 12. Only after rotor 3 has in this way been rotated back into its key removal position and locking bolt 10 has been brought into its new locking position can the key 29 be removed from key slot 20, which slot now indicates the new switch position. As a result, rotor 3 is secured against rotation relative to stator 3 by the tumbler groups 4 and locking bolt 10 is secured in its locked position against return displacement by operating link 9 of rotor 3 and lock cylinder 1 is secure against turning relative to engagement sleeve 6 by locking bolt 10.

Figure 12:
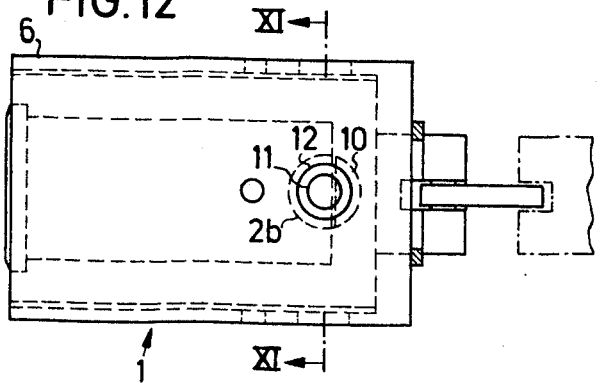

FIG. 12 shows lock cylinder 1 in the phase of rotation described relative to FIG. 11 with the key removed. After rotating stator 2 and rotor 3 by the net total of 90°, the rotary switch has engaged in its new operating position and is secured against unauthorized operation by locking bolt 10 and tumblers 4. The new rotation position of key slot 20 shows the associated new switch position in a conventional manner on an indexing plate which can conveniently be arranged on the front of the switch and surrounding lock cylinder 1, the plate being advantageously provided with a number of circularly disposed scale markings corresponding to the different switch positions.

Figure 13:
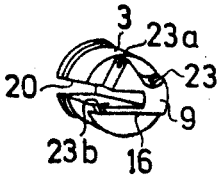
FIG. 13 is a perspective view of the rotor and link structure of the lock of FIGS. 1–12.

FIG. 13 shows a three-dimensional view of rotor 3 with its operating link 9 which is intergrally formed with cylindrical rotor body 3 and the shape of which is determined by a conventional milling operation. The recess 23 for receiving rotor holder 21 is provided in operating link 9. The milled key slot 20 extends through and up to the rear face of operating link 9.

Figure 14:
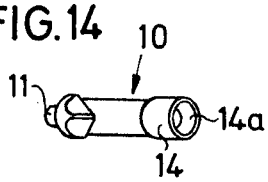
FIG. 14 is a perspective view of the operating bolt of the lock of FIGS. 1–12.

FIG. 14 shows a prospective view of locking bolt 10 which is, like rotor 3, produced from a cylindrical blank by conventional turning and milling operations. The U-shaped recess between the cylindrical end portions of locking bolt 10 is produced by milling. The locking lug 11 is turned on one cylindrical end portion, while the other sleeve-like cylindrical end portion, forming the locking bolt base 14, is provided with an inwardly extending cylindrical recess 14*a*, produced by milling or drilling, for receiving the locking bolt spring 13.

In the above-described lock cylinder, contrary to the conventional lock cylinder, whether the lock is used for operating a lock bolt or a rotary switch, the stator 2 is also mounted in rotational manner and the rotation angular path of rotor 3 relative to stator 2 is no longer dependent upon the radial position of the tumbler banks 4 and is dependent only upon the magnitude of the return movement of locking bolt 10 up to the mounting thereof on th inner wall of lock cylinder sleeve 5 as seen in FIGS. 1 and 5. Furthermore, in the lock cylinder 1, the tumbler pins 4*a* of rotor 3 when switching from one operating position into any other operating position no longer cooperate, as in the case of conventional switch cylinders, with, in each case, one other row of counter tumblers of the stator associated only with this other operating position. Instead, the tumblers always cooperate only with one and the same row of counter tumblers 4*b* because in any complete switching process, i.e., with any operational rotary path, after retraction of the locking bolt 10, the stator is always only rotated jointly with the rotor and is therefore carried by the latter in the rotation direction along the particular operating path. Unlike the case of the conventional lock cylinder, whatever purpose the ladder is used for, in this invention the rotor 3, apart from the relatively small rotational angular path relative to the stator 2 necessary for the retraction or re-advance of locking bolt 10 performs no rotary movement relative to stator 2 in the operating process. Thus, unlike the conventional switch cylinder, the key removal rotation position of rotor 3 remains unchanged relative to the jointly rotated stator 2 for any operating position of the rotary switch.

The operating characteristics of a rotary switch eqyipped with the above described lock cylinder are as follows. Initially, the inserted key 29 can be turned relatively easily against the limited resistance of locking bolt spring 13, moving rotor 3 alone, until the rotation resistance abruptly becomes considerably larger at the commencement of the simultaneous joint rotation of stator 2 with rotor 3 when the rotor contacts and begins to move locking bolt 10. Because of the force required to accomplish disengagement of spherical spring bolt 17 from engagement sleeve 6, the considerably larger disengagement resistance of spring bolt 17 exerts an effect on turning the key. On further turning of the key, the spherical spring bolt 17 under the pressure of bolt spring 18 engages suddenly in the next engagement opening 19 of engagement sleeve 6, which engagement is obvious to the operator, not only through the sudden decrease in the rotation resistance on the key, but also and more particularly through the snapping noise of the engagement of the spring bolt, and therefore the rotary switch, in its new operating position. The operator then exerts no further torque on the key, permitting the urging of locking bolt spring 13 to automatically return rotor 3 to the key removal rotational position, whereupon the key can be removed by the operator.

In order to obtain the "gentle" movement pattern of the locking bolt operation as compared with the relatively "hard" characteristics of the actual switch engagement through spherical spring bolt 17, it is not necessary for the bolt spring 18 to be substantially stronger than locking bolt spring 13. On the contrary, because of the two functions of the operating process, this difference is only a question of the difference size of the torques applied to the key by the operator.

Several modifications of the lock cylinder embodiment described hereinbefore and shown in the drawings are possible. For example, the actual lock cylinder engagement functionally occurring behind the locking bolt 10 or its operation, i.e., the engagement member (spherical spring bolt 17) used for this with the associated engagement openings 19 can be arranged in the actual switch located behind the lock cylinder 1, that is, arranged between the rotary and a stationary switch part. Furthermore, instead of constructing the stationary switch part provided with locking and engagement openings 12 or 19, respectively, as an engagement sleeve 6 wherein the rear sleeve base of the latter is fixed by means of screws to the fixed front switch plate 8 as described in connection with FIG. 2, the actual switch casing can be used forthis purpose. Thus, the lock cylinder sleeve 5 can be mounted in rotational manner therein, as is indicated in FIG. 2 at 6*a*, so that the locking and engagement openings can then be arranged in the switch casing where they would be in the form of blind bores instead of through openings.

Still further, the tumbler banks 4 need not, as shown in the example of FIG. 2, be arranged in a plane perpendicular to the sides of the key slot 20. Instead, they could be arranged in other longitudinal median planes of lock cylinder 1 because the location of the tumbler banks 4 is independent of the locking mechanism provided in the rear portion of the lock cylinder, i.e., independent of the arrangement of the operating link 9, locking bolt 10 and locking openings 12. In addition, the arrangement is substantially independent of the arrangement of the operating engagement member 17 and its engagement openings 19. In fact, this operating engagement device which only requires a small amount of space in stator 2 can be arranged both in the associated plane at right angles to the lock cylinder axis and in the associated longitudinal median plane of the lock cylinder between the tumblers. Instead of placing the engagement openings 19 in the same perpendicularly directed longitudinal median planes of the lock cylinder in which the locking openings 12 for bolt 10 are provided, they could alternatively be arranged in two other random perpendicular planes because there is no need for the operating engagement member 17 in stator 2 to be located in the longitudinal median plane of stator 2 perpendicular to the axis of the receiving bore 2*b* for locking bolt 10. Instead, they can be arranged in any other longitudinal median plane.

The advantage of the above-described cylinder lock with a plurality of key removal positions for rotary switches is that the lock cylinder is no longer limited to three or a maximum of eight tumblers but can, instead, be constructed as a complete cylinder without any restriction on the permutation. Thus, it is possible to use all single or multibank pin cylinders or plate cylinders. A further advantage is that on the switch cylinder up to 12 switch positions (with a minimum angle of about 30°) are now possible in place of the previous maximum of four because they represent a secondary function independent of the function of identification between key and lock cylinder. Thus, their number can be selected independently of the arrangement and number of tumblers in the lock cylinder. The largest possible number of switch positions is substantially only limited by the number of locking and engagement openings which can be, as a practical matter, provided on the periphery of the stationary switch part or engagement sleeve for a given lock cylinder diameter, bearing in mind the strength requirements. For a given diameter of these openings this usually results in a minimum pitch angle of about 30°.

While certain advantageous embodiments have been chosen to illustrate the invention, it will be understood by those skilled in the art that various changes and modifications can be made therein without departing from the scope of the invention as defined in the appended claims.

What is claimed is:

1. A cylinder lock for a rotary switch of the type having a stationary part and a movable part rotatable to any one of a predetermined number of positions, the lock comprising the combination of a stationary housing coupled to the stationary part of said switch, a stator mounted for rotary motion in said housing and coupled to the movable part of said switch;

means for restraining said stator against axial motion relative to said housing;

a rotor mounted in said stator for rotary motion relative thereto, said rotor having an operator link attached thereto and rotatable therewith, and a key slot to permit insertion and removal of a key in any one of a plurality of rotational positions of said rotor, the positions of said key slot providing a visible indication of switch position;

tumbler means in said rotor and stator for preventing relative motion therebetween in the absence of a key in said slot;

a locking bolt coupled to said link, said stationary housing having means defining a plurality of locking openings corresponding to the number of switch positions for receiving an end of said bolt, said locking bolt being transversely movable between a first portion in which said bolt engages one of said locking openings in said housing and a second position in which said bolt is disengaged from said openings, said bolt being movable toward said second position by said link upon rotation of said rotor;

spring means for urging said bolt toward said first position;

said stator being locked against rotation by said bolt when said bolt is in said first position, said stator, said rotor and said bolt being rotatable relative to said housing when said bolt is in said second position to move said switch to a new position, the number of said locking openings being selectable independently of the number and arrangement of tumbler means in the cylinder lock.

2. A cylinder lock according to claim 1 and further comprising a spring-urged operating engagement member mounted in said stator in a plane perpendicular to the rotation axis of said rotor, means defining a plurality of engagement openings for receiving sad engagement member, the number of said openings corresponding to the number of locking openings, said engagement openings being disposed relative to said locking openings so that said engagement member engages an engagement opening in each rotational position of the stator defined by the engagement of the locking bolt in a locking opening whereby the rotational position of said stator and the rotary switch is fixed in the appropriate switch position.

3. A cylinder lock according to claim 1 wherein said locking belt is formed with a generally cylindrical outer surface and is mounted for motion parallel to its axis in two coaxially aligned radial bores in said stator, and wherein said housing is formed with a cylindrical opening to receive said stator, said stator having a surrounding sleeve;

said locking openings being circularly arranged in said housing in a plane perpendicular to the rotation axis of said rotor; and said spring means comprises a compression spring mounted in one of said bores to act between said bolt and the inner surface of said sleeve.

4. A cylinder lock according to claim 1 wherein said operating link is integrally formed on the end of said rotor opposite the end of said key slot into which the key is insertable with said slot extending through said link.

5. A cylinder lock according to claim 1 wherein said locking bolt is formed with a U-shaped side recess into which said link extends, a locking lug at one end and a sleeve-like recess at the other end to receive said spring means, said locking bolt and said link having mutually abutting surfaces when said bolt is urged by said spring means into said first position, said surfaces having a common pressure transfer point for urging said bolt toward said second position, and said stator having a surrounding sleeve contacted by said other end of said bolt in said second position.

6. A cylinder lock according to claim 1 wherein the cross-section of said operating link approximates an isosceles triangle the apexes of which lie adjacent the outer cylindrical surface of said rotor, wherein one end of said locking bolt being engageable in said locking openings, said end being formed with an arrow-like shape in the same cross-sectional plane as the operating link and wherein the base of the link cross-sectional triangle is a generatrix of the link engagement surface and the two perpendicular sides of the triangle are generatrixes for receiving members, formed opposite to the periphery of the rotor, for the locking side locking bolt members moved in the direction of the operating link on retracting the locking bolt from its locked position.

7. A cylinder lock according to claim 1, wherein the stationary switch part is constructed as an engagement sleeve, said sleeve being mounted from the rear on the lock cylinder sleeve and provided on its outer periphery with locking openings in the form of radial through-openings, and wherein threaded bores are provided in the rear sleeve base for fixing the cylinder lock to the switch casing, whereby a cylindrical stator shoulder passing through said casing serves to couple the stator with a rotary switch part arranged coaxially to the lock cylinder axis and wherein the stator is fixed in the engagement sleeve so that it cannot move axially forward by a securing member arranged on the stator shoulder behind the sleeve base.

8. A cylinder lock according to claim 1, wherein said engagement member comprises a spherical spring bolt mounted in one of the stators and the rotary switch part.

9. A cylinder lock according to claim 8, wherein said spherical spring bolt is mounted in the stator and tensioned by a radially positioned bolt spring and is supported in its engagement position on the edge of a through-opening radially arranged on the outside of the lock cylinder sleeve and which serves as a stop member.

10. A cylinder lock according to claim 9, wherein the engagement openings for the spherical spring bolt, which are in the form of through-openings are located on the outside of the engagement sleeve and wherein on the cylinder lock the plane common to the spherical spring bolt and its engagement openings are positioned in front of the plane common to the locking bolt and its locking openings.

11. A cylinder lock according to claim 1, and having a lock cylinder sleeve including on the rear end of the outside of the sleeve a radial through-opening arranged in a plane common to the locking openings of the stationary switch part for the passage of the locking bolt extended through the lock cylinder sleeve into a locking opening.

12. A cylinder lock according to claim 1, wherein the rotor is secured against axial displacement in the stator by a rotor holder laterally positioned in the stator in a plane perpendicular to the rotor axis.

13. A cylinder lock according to claim 12, wherein the plate-like rotor holder engages in a slot of the operating link constructed as a rotor shoulder.

* * * * *